US005305977A

United States Patent [19]

Roth

[11] Patent Number: 5,305,977

[45] Date of Patent: Apr. 26, 1994

[54] LADDER PAINT BUCKET HOLDERS

[76] Inventor: Alfred C. Roth, 2388 Yost Blvd., Ann Arbor, Mich. 48104

[21] Appl. No.: 879,986

[22] Filed: May 8, 1992

[51] Int. Cl.[5] ..... E06C 7/14

[52] U.S. Cl. ..... 248/210; 248/211

[58] Field of Search ..... 248/210, 211, 312.1

[56] References Cited

U.S. PATENT DOCUMENTS

| | | | |
|---|---|---|---|
| 2,453,670 | 11/1948 | Persson | 248/210 |
| 2,508,258 | 5/1950 | Heinrich | 248/210 |
| 2,634,937 | 4/1953 | Welsh | 248/211 |
| 3,203,658 | 8/1965 | Brown | 248/211 |
| 3,220,682 | 11/1965 | Hannon | 248/211 |
| 3,272,467 | 9/1966 | Kassube | 248/211 |

*Primary Examiner*—Richard K. Seidel

*Assistant Examiner*—Raymond D. Woods

*Attorney, Agent, or Firm*—John B. Dickman, III

[57] ABSTRACT

A receptacle support for supporting a receptacle such as a paint can on a ladder rung or rail. The receptacle support is constructed of a steel rod having a plurality of bends to provide a hook end and a clamp receiving end. There is a bend in the center of the rod to provide a pair of arms. The bend has an angle greater than 90 degrees, where the hook end engages an end of a ladder rail and one of the arms rests on a rung. The other arm extends downwardly where a clamp holds a receptacle on the outside of the ladder. A spring securing device attached to the steel rod and stretched so it attaches to the hook end. When the securing device is in place the receptacle support and spring encircle a ladder rail to stabilize the receptacle holder and receptacle.

9 Claims, 2 Drawing Sheets

LADDER PAINT BUCKET HOLDERS

BACKGROUND OF THE INVENTION

This invention relates to a receptacle holder of the type supported on a ladder rail or rung and in particular a receptacle holder which is secured to a ladder.

It has been pointed out that devices of this type are of utility to painters, window washers, carpenters, fruit pickers and others who desire or need a receptacle held in some position handy to their work. The principal object of receptacle holders is to place a receptacle at or near a work area and to insure that the contents of the receptacle will not spill.

Heretofore, several receptacle holders have been patented, however each of these devices lack critical features. In the first place they are limited to a particular type structure on which they attach. And secondly, they do not provide a positive type securing device.

A primary object of the invention is to provide a receptacle holder that can be secured to different structures.

A study was made of the patented art relative to the present invention and the following listed patents are of interest:

U.S. Pat. No. 2,102,078 issued to Kemp
U.S. Pat. No. 2,308,805 issued to Dahl
U.S. Pat. No. 2,453,670 issued to Persson
U.S. Pat. No. 2,597,756 issued to Sitek
U.S. Pat. No. 2,634,937 issued to Welsh
U.S. Pat. No. 3,108,776 issued to Cook
U.S. Pat. No. 3,013,759 issued to Close
U.S. Pat. No. 3,625,388 issued to Golden
U.S. Pat. No. 4,053,131 issued to Francis The Persson patent is directed to a receptacle support with a hook to hang the support on a ladder rung. Persson provides a clamp with a movable jaw on a threaded member to grip the side wall of a receptacle. Other patents which show a receptacle holder with a clamp to grip the wall of a receptacle are Dahl, Close and Cook.

A feature of interest to the present invention is shown in the patents to Dahl, Welsh and Close where the receptacle support is hung from a ladder rail with the receptacle on the outside of the ladder to provide easier access. Dahl uses a hook to engage a rung and an L-shape member attached to the hook to wrap around a rail. Welsh shows a pair of L-shaped members that are spring biased together to partially wrap around a rail. In Close, the support has a U-shaped end which wraps around a rail using the weight of the receptacle to hold the support in place. These patents lack a security means to prevent the receptacle holder from losing its holding force and spilling the contents of the receptacle.

There are two patents which teach a tether for holding a support on a ladder. The Francis patent uses a flexible tether with a snap hook which is fastened to the tether after it has been wrapped around a rung. Golden uses a similar tether and snap hook to connect a support to a ladder rung. The tethers of the Francis and Golden patents are not applicable to the present invention, which will become apparent in the disclosure.

SUMMARY OF THE INVENTION

The present invention is directed to a novel receptacle support which is a one-piece construction which is provided with a securing means to prevent the support from slipping and spilling the contents of the receptacle.

In the preferred embodiment of the invention a receptacle support is constructed of a steel rod having a series of bends to partially wrap around a ladder rail. The first two bends are on each end of the rod at right angles to the section between the bends. The bends are in the same plane and direction. One end of the rod has a receptacle clamp. The other end of the rod has in addition to the first bend two other bends. One bend is in the same plane as the first bend and at a right angle, the other bend is also at a right angle, however, it is in a perpendicular plane to the first plane. The last mentioned bend provides a hook which forms part of a securing means. An elastic or stretchable element connected to the receptacle support wraps around the portion of the ladder rail which the support does not wrap around, and the element connects to the hook. The combination of the force of the securing means and the weight of the receptacle create several pressure points against the ladder rail where it is contacted by the receptacle support. These pressure points aid in stabilizing the support and receptacle.

The second embodiment of the invention of the receptacle support is also constructed of a steel rod. One end is bent at a right angle and has a receptacle clamp. The other end of the rod is bent to provide a hook to fit on a ladder rung. The free end of the hook is bent at a right angle and in the same plane as the hook. An elastic or stretchable element is connected to the receptacle support to wrap around the portion of the rung not covered by the hook, and connected to the free end bent at a right angle to secure the support to the rung.

Referring to the paint can holder for extension ladders, which have round or D-shaped rungs, the user places the semi-circular hook over the rung and proceeds to paint. There is some danger that the hook can be accidentally jarred or raised as the painter moves up or down the ladder thereby disengaging the hook from the rung and dropping the can of paint. To prevent this possibility, the improvement provided by this invention consists of an extension spring with a closed loop at each end. After the user places the hook over the rung, the spring is stretched and the closed loop is placed over the flattened end as illustrated. This prevents the hook from being removed until the spring is intentionally stretched and released from the flattened end by the person using the device.

DESCRIPTION OF THE INVENTION

Figure 1:
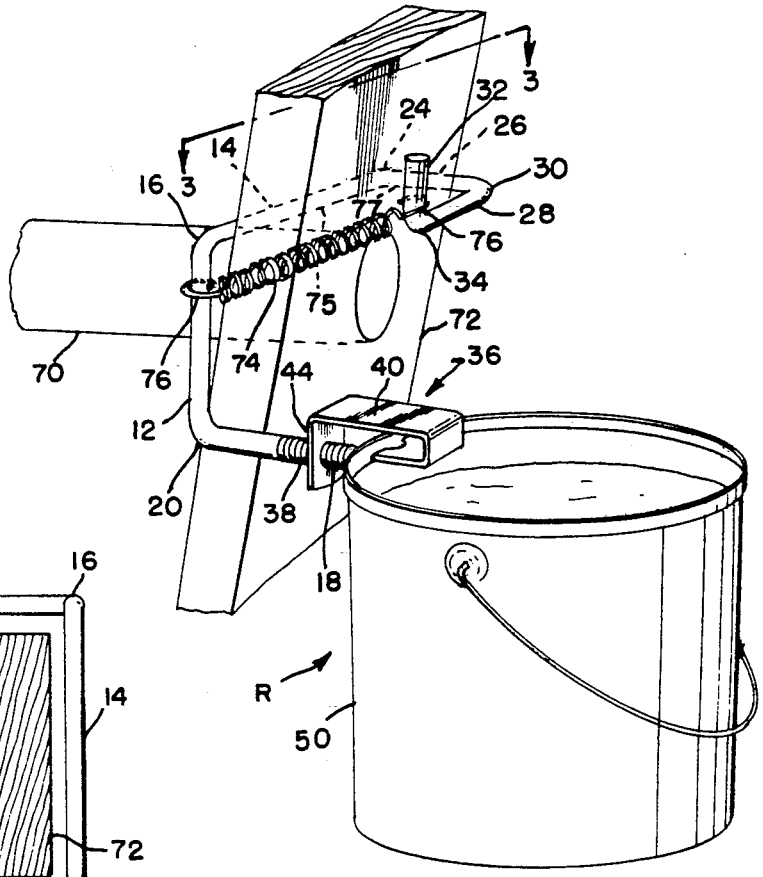
FIG. 1 is a perspective view of a receptacle support of the present invention showing the receptacle support on the right side of a ladder.

Referring to the drawings, FIGS. 1–5, there is shown a receptacle support 10. The receptacle support 10 is constructed of a steel rod having several bends for attaching the support to a ladder. In general, the support connects to one of the vertical rails and is supported on a ladder rung. The receptacle support 10 has two arms 12 and 14 at an angle $\theta$ to each other and formed by bend 16. An angle of 100 degrees has been found to be appropriate for connecting and supporting the receptacle support on a ladder, as will be explained. Arm 12 has a right angle end member 18 formed by a bend 20 where end member 18 is in a plane perpendicular to the plane of the bend 16 and arms 12 and 14. There is an end member 22 formed by a bend 24 to a right angle and in the same perpendicular plane as end 18.

End member 22 has a first member 26 and a second member 28 formed by bend 30 at right angles to each other and where number 28 is parallel to arm 14. The end member 22 and right angle bends 24 and 30 create a hook with arm 14, first member 26 and second member 28. A third member 32 is formed by a right angle bend 34. Member 32 is in the same plane as arm 14 and extends in a direction outside of the 100 degree angle forming arms 12 and 14. Each of the bends and end members are important to the use of the receptacle support 10.

Figure 3:
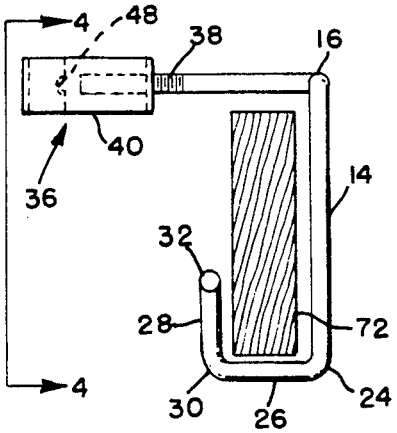
FIG. 3 is a view taken along the line 3—3 of FIG. 1.

A clamp 36 is screw threaded on end 18 which has screw threads 38. Clamp 36 has a horizontal part 40 and portions 42 and 44 depending therefrom. An inner jaw 46 on the portion 42 extends inwardly in more or less parallelism with the horizontal part 40 and its inner end is concaved at 48, as shown in FIG. 3. The portion 44 will be referred to as an outer jaw.

Figure 6:
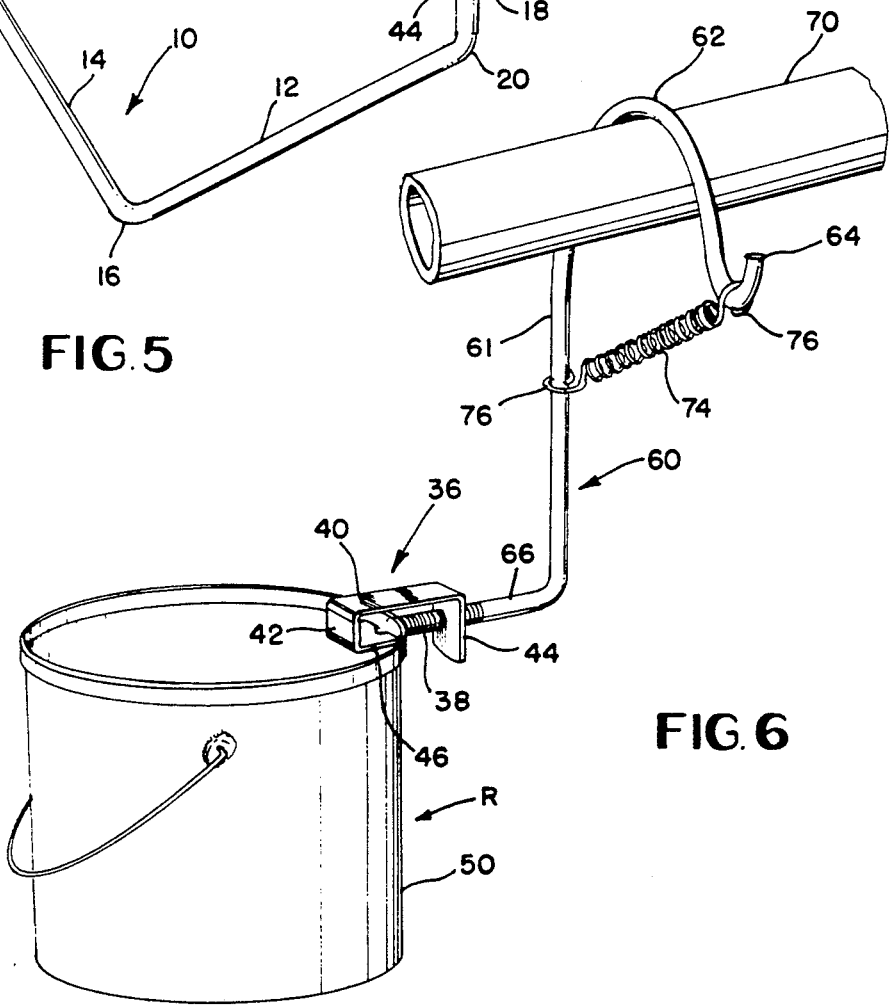
FIG. 6 is a perspective view of another embodiment of the invention.

A receptacle is represented at R which may be a paint can and the jaw portion 46 of the clamp 10 engages the inner side of its side wall 50, best shown in FIG. 6. The clamp 10 is rotated until the end of the threaded end 18 engages the wall 50 and presses it against the inner jaw 46. In this way, the can R is clamped by the receptacle support which supports it.

Figure 2:
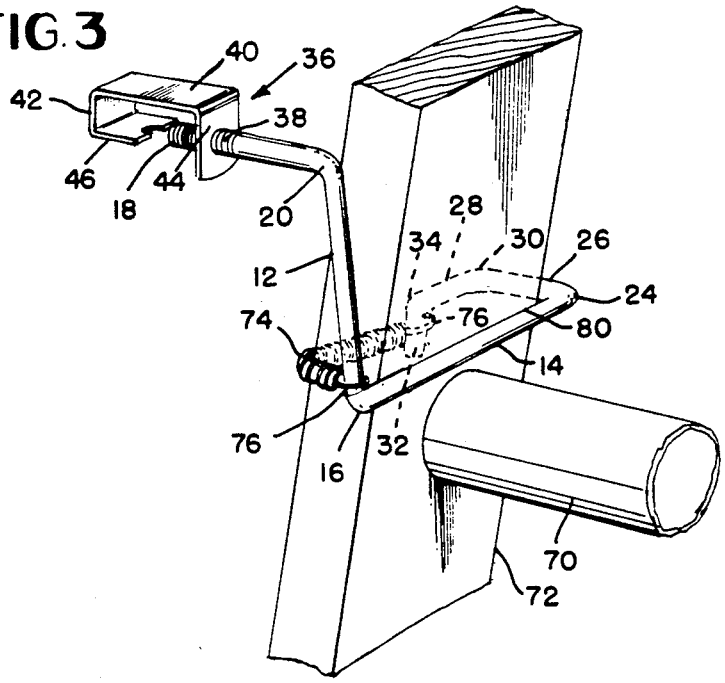
FIG. 2 is a perspective view showing a receptacle support of the present invention with the receptacle support on the left side of a ladder.
Figure 4:
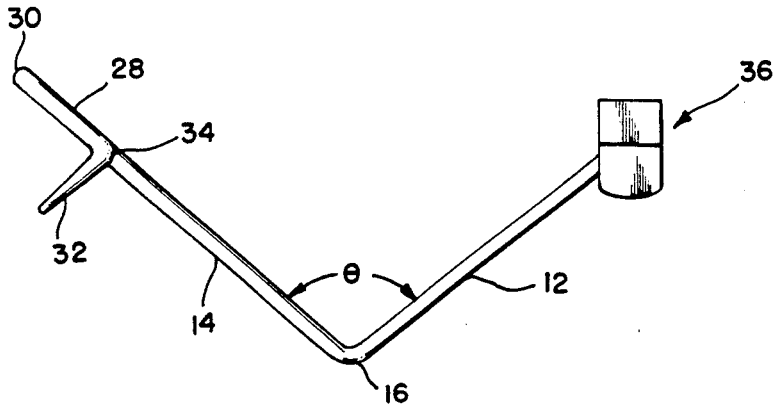
FIG. 4 is a side view taken along the line 4—4 of FIG. 3.
Figure 5:
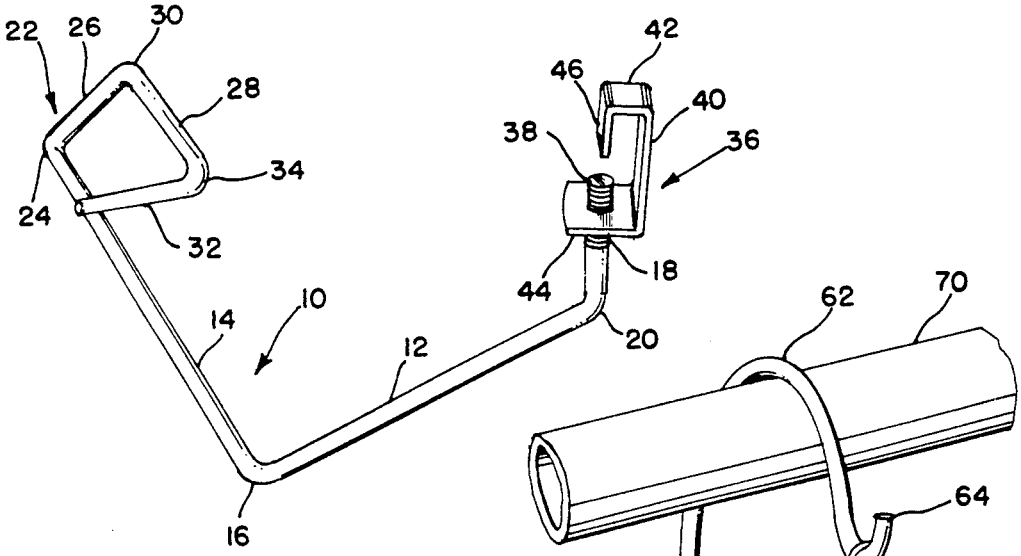
FIG. 5 is a perspective view of a receptacle support of the invention.

The clamp 36 being secured to can R after the manner described may be in turn be supported by receptacle support 10, or as in FIG. 6 receptacle support 60 on a ladder as shown in FIGS. 1, 2 and 6.

The embodiment in FIG. 6 shows a steel rod 61 bent to provide a hook 62 with a right angle member 64. On the other end of the receptacle support 60 is a member 66 at a right angle to rod 61. Member 66 is bent perpendicular to the hook 62, and has screw threads 38 to receive a clamp 36. In use, a paint can R is clamped to receptacle support 60, using clamp 36 as described. The hook 62 is hooked on a ladder rung 70 to support the can R.

The receptacle supports 10 and 60 are secured to a ladder having rails 72 and rungs 70 by a spring securing device 74. Spring 74 has loops 76 on each end. One loop 76 is connected to arm 12 and the other loop to member 32 of the receptacle support 10, to provide a closed loop around either the ladder rail 72 when using receptacle support 10, or the rung 70 when using support 60.

FIG. 1 shows receptacle support 10 with its hook end member 22 wrapped around one end of the ladder rail 72, (FIG. 3). Arm 14 is of a length to span beyond the width of rail 72. Arm 12, which has a shorter length than arm 14, projects downwardly due to bend 16 and the angle of 100 degrees. End member 18 extends across the thickness of rail 72 and beyond to receive clamp 36.

There are several points where the receptacle support applies force to the ladder rail 72 and rung 70. The first and most obvious point of force is where arm 14 contacts rung 70, as shown at 75. There are two points of force at bend 30 and at 77 on member 26. The final contact point is where member 18 contacts the thickness of rail 72. These points of force are the results of the shape of receptacle support 10. The important features of the shape of the support 10 allow the support 10 to slip around rail 72 and provide points of force which stabilize the support and the receptacle clamped to it. The spring securing device 74 also provides stabilization of receptacle R by applying constant pressure, pulling end members 18 and 26 against the ladder rail.

While the receptacle support 10 shown in FIG. 1 attaches to the right side rail of a ladder, the support 10 can also attach to the left side rail 72 as shown in FIG. 2. To attach the receptacle support 10 the support 10 is turned 180 degrees where end member 32 is pointed down. The hook end member 22 is wrapped around one end of ladder rail 72. Arm 14 rests on rung 70 and extends beyond the rail. Arm 12 projects upwardly, instead of down as in FIG. 1, and end member 18 extends across the thickness of rail 72 and beyond to receive clamp 36. Receptacle support 10 has points of force including the contact arm 14 with rung 70, the area around bend 24, which may include an area 80 on arm 14. The final point of force is the contact member 32 against rail 72. Again these points of force are a result of the shape of receptacle support 10.

In use, the receptacle support 10 is clamped to the wall of a receptacle R by tightening clamp 36 against the end of end member 18 with the receptacle between the clamp and end member 18. The hook end member 22 is wrapped around one of the rails 72 where arm 14 rests on rung 70. Arm 12 projects downwardly due to bend 16, which is greater than 90 degrees and less than 135 degrees, a 100 degree bend being preferred. Spring securing device 74 is stretched between arm 12 and end member 32 to encircle rail 72. The weight of the receptacle R and the force of the spring 74 press end members 18 and 26, FIG. 1, against the ends of rail 72. In FIG. 2, member 18 is held away from rail 72 by the weight of receptacle R.

To use the embodiment of FIG. 6, the receptacle R is clamped to receptacle support 60. Spring securing device 74 is connected at one end to rod 61 and to member 64 at the other. Before the spring is attached to member 64, support hook 62 is hooked over rung 70 and the spring is attached to encircle the rung.

It can be appreciated that the use of spring securing device 74 prevents accidental removal of either receptacle support 10 or 60. In addition, when used with receptacle support 10, the spring securing device 74 functions to press members 18 and 26 against the rail.

I claim:

1. A receptacle support for supporting a receptacle on a ladder, comprising:

a metal rod having a plurality of bends to provide a hook means at one end and a clamp receiving end at the other end;

said metal rod having a first arm and a second arm, an angled bend in said rod separates said first arm and said second arm, where said first arm has a length greater than a ladder rail width and said second arm having a length less than said first arm;

said hook means having a first member at a right angle to said first arm and parallel to said clamp receiving end and a second member at a right angle to said first member, where said second member being parallel to said first arm, and said hook means being on said first arm;

a third member on said second member and at a right angle to said second member, where said third member extends in a plane parallel to said first arm and in a direction outside of said angled bend; and a clamp means on said clamp receiving end for moving along said end, where said clamp means clamps on a side wall of a receptacle and supporting said receptacle on said receptacle support, whereby said hook means wraps around one end of a ladder rail and said first arm engages a rung on said ladder.

2. A receptacle support as in claim 1 wherein said angled bend is greater than 90 degrees and less than 135 degrees.

3. A receptacle support as in claim 2 wherein said angled bend is 100 degrees.

4. A receptacle support as in claim 3 wherein said first arm having an end on which said hook means extends.

5. A receptacle support as in claim 5 wherein said second arm having an end on which said clamp receiving end extends.

6. A receptacle support as in claim 5 wherein an elastic securing means connects to said second arm and to said third member.

7. A receptacle support as in claim 6 wherein said elastic securing means is a spring having connectors on each end to connect to said second arm and to said third member.

8. A receptacle support as in claim 1 wherein an elastic means is connected to said second arm and extends around the ladder rail to connect to said third member, thereby encircling said ladder rail with said receptacle support and said elastic means.

9. A receptacle support as in claim 10 wherein said elastic means is a coiled spring having a pair of loop ends to connect to said second arm and to said third member.

* * * * *